US005114600A

United States Patent [19]

Biggin et al.

[11] Patent Number: 5,114,600

[45] Date of Patent: May 19, 1992

[54] FABRIC CONDITIONERS

[75] Inventors: Ian S. Biggin, Cardiff; Peter S. Cartwright, South Glamorgan, both of United Kingdom; David Farrar; Malcolm Hawe, both of West Yorkshire, England; Walter E. Paget, Cardiff, United Kingdom

[73] Assignee: BP Chemicals Limited, London, United Kingdom

[21] Appl. No.: 603,665

[22] PCT Filed: Apr. 19, 1990

[86] PCT No.: PCT/GB90/00600

§ 371 Date: Oct. 29, 1990

§ 102(e) Date: Oct. 29, 1990

[87] PCT Pub. No.: WO90/12862

PCT Pub. Date: Nov. 1, 1990

[30] Foreign Application Priority Data

Apr. 21, 1989 [GB] United Kingdom ..... 8909069

[51] Int. Cl.[5] ..... D06M 10/08

[52] U.S. Cl. ..... 252/86; 252/87; 252/8.75; 252/8.8; 252/8.9; 252/174.23; 252/174.24

[58] Field of Search ..... 252/8.6–8.9, 252/174.23, 174.24

[56] References Cited

U.S. PATENT DOCUMENTS

| | | | |
|---|---|---|---|
| 3,674,902 | 7/1972 | Kalopissis | 424/70 |
| 4,240,450 | 12/1980 | Grollier et al. | 8/404 |
| 4,364,837 | 12/1982 | Pader | 252/174.23 |
| 4,678,606 | 7/1987 | Akhter et al. | 252/174.24 |

OTHER PUBLICATIONS

Zviak, Charles. The Science of Hair Care, 1986, pp. 49–63, ISBN 0-8247-7378-0.

*Primary Examiner*—A. Lionel Clingman
*Assistant Examiner*—William S. Parks
*Attorney, Agent, or Firm*—Brooks, Haidt, Haffner & Delahunty

[57] ABSTRACT

This invention relates to fabric conditioning formulations containing as thickeners a cross-linked cationic polymer of an ethylenically unsaturated monomer or blend of monomers, wherein the cross-linking agent is 5–45 ppm of a cross-linking agent comprising polyethylenic functions. An example of such a cross-linking agent is methylene bisacrylamide. Such thickeners do not contribute to the opacity of the formulations and have a relatively good viscosity stability.

28 Claims, No Drawings

FABRIC CONDITIONERS

This invention relates to fabric conditioning formulations. Most domestic detergents use the thickening properties of the surfactant ingredients and/or added salts to achieve the rheology desired for a particular application, preferably to avoid extra costs. However in many cases either the formulation is not stable physically or rheologically, or the rheology cannot be adjusted to that required, or, the ingredients have no rheology modifying properties over the useful range of combinations. In this case, the common practice is to use polymeric or mineral thickeners with suitable properties to build the rheological properties of the product. The most cost effective thickeners are usually chosen bearing in mind the limitations of formulating the thickener into the formulation. One particular aspect of thickening domestic detergent products is to improve product appeal to consumers. Another aspect closely related to improving product appearance is to adjust the appearance of the product by adding opacifiers.

Rinse-cycle fabric conditioners are mainly based on fatty cationic surfactants, used either alone or in combination with suitable non-ionic/fatty co-softeners, which are attracted to a fabric surface where they adsorb and impart a soft handle or feel. Minor ingredients may be added which improve stability, in addition to conventional colouring agents and perfumes. In other types of formulation, the main role of the cationic component is to render the other neutral fatty softeners as surface substantive, so they too are carried to the fabric surface to create a soft handle or feel. It is known that products with viscosities between about 100–400 cP at 20 sec-1 (25° C.) are consistently preferred to products with around half the respective viscosity or less at a shear rate consistent with consumers pouring the product or observing the product flowing on inclined surfaces.

It is well known that controlling the rheology and physical stability of cationic softener formulations is difficult. This is due to the fact that cationic surfactants are disrupted and rendered ineffective by a wide range of materials. Anionic species, either dissolved or suspended may adsorb or precipitate the surfactant, causing both rheological and physical instability i.e. the product may become too thick or too thin, or phase separation of the aqueous phase may occur. Thus, unless used to form neutral fatty softening species or to deliberately thin the formulation e.g. liquid concentrates, anionic surfactants and additives are avoided by the industry. The formulations cannot therefore be thickened using anionic polymer thickeners. Mineral thickeners with exchangeable cations e.g. montmorillonite clays, usually cause instability, or do so when the surfaces become charged or polarised in aqueous dispersion.

Neutral and cationic polymers would be expected to be more stable in the presence of fatty cationic softeners. Such polymers are commercially available and, in the case of substantially water-based products in which they are soluble or dispersible, the polymers are substantially linear in structure. Such polymers are effective because they are essentially completely dissolved in the aqueous phase, where they may either structure the aqueous phase or physically interact with either other polymers and/or the surfactant phase. These polymers suffer from one or more of the following disadvantages:

1) The dissolved polymer is free to interact at the molecular level with the dispersed cationic softener, and may flocculate or precipitate the softener and co-softeners. "Dissolved" in this context means that the polymer at user concentration forms clear or slightly hazy solutions.
2) Such soluble polymers are unlikely to contribute to the opacity of the formulation. Thus dilute fabric conditioners may require additional opacifiers. This is a significant added cost to the formulation.
3) Experience shows that soluble cationic polymers are less stable than nonionic/neutral polymers int he longer term, presumably because the dissolved polymer behaves partly as an electrolyte, thereby causing osmotic and electrostatic instability int he cationic disperse phase.
4) The rheological properties of these soluble polymers tend to be non-linear over the concentration range where perceivable thickening occurs. Beyond certain values e.g. 1% w/w concentration, the viscosity rises so rapidly that viscosity control may be a problem.
5) Where the dissolved polymer precipitates itself of flocculates the cationic surfactant, it is difficult to redisperse the polymer and regain the thickening effect.
6) Effectiveness of the thickening performance in these soluble polymers is retained by supplying as 100% active materials. These materials, unless expensively modified, can be difficult to disperse and may require expensive equipment to achieve dissolution.
7) Cationic and high molecular weight polymers would be expected to build up irreversibly on treated fabric.
8) Naturally derived polymers e.g. locust bean and guar gums, may be degraded by contaminant bacterial enzymes, causing loss of viscosity int h product. Polymers derived form fermentation processes may also themselves be contaminated by bacteria with risk of product spoilage.
9) Many natural and synthetic polymers are unstable in the pH range e.g. 2.5–5 where rinse conditioners are normally formulated.

It has now been found that substantially all these problems can be mitigated by using a crosslinked, acrylamide copolymer containing cationic groups as thickener which also obviates the need for a separate opacifier.

Accordingly, the present invention is an aqueous based fabric conditioning formulation comprising a water dispersible cationic softener and a thickener characterised in that the thickener is a cross-linked cationic polymer that is derivable from a water soluble cationic ethylenically unsaturated monomer or blend of monomers, which is cross-linked by 5 to 45 ppm of a cross-linking agent comprising polyethylenic functions.

The cross-linked, cationic polymers, (hereafter "CP"), are formed from monoethylenically unsaturated monomer that is either a water soluble cationic monomer or is a cationic blend of monomers that may consist of cationic monomers alone or may consist of a mixture of cationic and non-ionic monomers in the presence of a cross-linking agent. If a blend of monomers is being used then part of the blend may have a low water solubility providing the blend is water soluble. The monomers can be allyl monomers but are generally vinyl, preferably acrylic.

Suitably, the cationic polymers are derivable from cationic monomers comprising one or more of (a) dialkylaminoalky-acrylates and methacrylates, especially dialkylaminoethyl acrylate, (b) dialkylaminoalkylarylamides or -methacrylamides and (c) the quaternary or acid slats of (a) or(b), for instance methacrylamidopropyl trimethyl ammonium chloride and Mannich products such as quaternised dialkylaminomethylacrylamides. Alkyl groups are generally $C_{1-4}$ alkyl.

Suitable non-ionic monomers are acrylamide, methacrylamide, N-vinyl pyrrolidone, and lower alkyl water insoluble acrylic (or other ethylenically unsaturated) monomers such as methyl methacrylate, styrene or acryloniltrile which may be included in sufficiently small amounts so that the blend is soluble.

Blend of 5-90%, preferably 5-50%, acrylamide with dialkylaminoalkyl-acrylate or, preferably -methacrylate as acid addition or quaternary addition salts, or, cationic homopolymers (containing no acrylamide groups) are preferred.

The monomers can contain hydrophobic groups ,e.g., as described in EP-A-0172723, for instance on page 10 of the specification. If the monomer is to impart insolubility to the polymer, ethoxy chains, if any, should be short or absent, i.e., n=0. The allyl ether monomers are especially preferred.

The cationic polymer must be added while in the form of particles below 10 micrometers in size, and preferably below 2 micrometers in size. These can be made by comminuting a cross-linked polymer gel but preferably the particles are formed initially in the cross-linked state. The particles may be added to the aqueous solution as disintegratable aggregates or pellets, but preferably are added as dispersion in a liquid, generally a non-aqueous liquid such as a hydrocarbon. This dispersion may be made by dispersing preformed particles in the liquid but is preferably made by reverse phase polymerisation of the monomer or monomer blend in the presence of the cross linker.

The monoethylenically unsaturated starting material may be contaminated with a small amount of crosslinking agent and the amount of additional cross-linking agent that is added will therefore be selected having regard to this. Preferably the monoethylenically unsaturated material is as free of cross-linking agent as is commercially possible, for instance containing cross-linking agent in an amount that gives cross-linking or chain branching less than is given by e.g. ppm of a cross-linking agent comprising polyethylenic functions used in the present invention By the term "polyethylenic functions" as used herein and throughout the specification is meant cross-linking agents which have two or more ethylenically unsaturated groups per molecule of the agent. Thus, an example of such an agent is methylene bisacrylamide (hereafter "MBA"). The amount of cross-linking agent with polyethylenic functions e.g. MBA that is added is at least 5 ppm and upto 45 ppm (based on monomer), generally from 10 to 40 ppm. The precise amount will depend upon the polymerisation and other processing conditions. Instead of using MBA, cross-linking may be by equally achieved by using effective amounts of other diethylenically unsaturated compounds such as ethylene glycol di-acrylate, diacrylamide, cyanomethylacrylate, vinyloxyethylacrylate or methacrylate and other means of cross linking, e.g., formaldehyde or glyoxal or metal salt addition. Preferably a water-soluble cross-linking agent is used.

The degree of non-linearity can additionally be controlled by the inclusion of chain transfer agents in the polymerisation mixture. Their use, in combination with cross-linking agent, will tend to promote chain branching rather than cross linking. Amounts may vary widely. For instance 1,000 to 5,000 ppm (based on monomer) of a moderate chain transfer agent such as isopropyl alcohol may be suitable whilst much lower amounts, typically 100 to 500 ppm, of more effective chain branching agents such as mercaptoethanol are useful. Often, however, adequate results are obtained by conducting polymerisation under conventional conditions without deliberate addition of chain transfer agents, using commercially pure monoethylenically unsaturated monomer together with the specified amount of MBA or other cross-linking agent.

Preferred CP's are often formed from 0 to 40% w/w acrylamide and 100 to 60% w/w dialkylaminoethyl methacrylate quaternary salt (for instance 20% acrylamide 80% dimethylaminoethyl methacrylate quaternary salt) cross linked with 10 to 40 ppm, preferably 10-30 ppm of MBA or other cross linker. All parts and percentages are by weight. The precise optimum for any particular composition can be determined by observing the properties of the composition when thickened with the chosen amount of a range of CP's differing from one another solely by differing the amounts of MBA from 5 to 45 ppm.

The amount of CP typically may be in the range of 0.01% to 0.5%, often 0.02% to 0.2%, by weight CP based on the aqueous composition.

The polymerisation conditions are preferably such that the polymer has, if uncross-linked, a notional high molecular weight of 5 million to 30 million and an intrinsic viscosity (hereafter IV) of above 4, preferably above 6, e.g., up to 10 or 15 dl/g. If the polymer is cross linked (CP) it is preferably polymerised such that it would have such molecular weight if it had been made in the absence of cross linking agent. However cross linking will reduce the IV but the shearing may then cause the Iv to increase, as explained below.

The particle size in the emulsion or reverse phase polymerisation mixture may bs controlled by the degree of shear applied to the monomers and by the possible presence of emulsifying agent. Emulsion polymerisation may be utilised when polymerising, for instance, water insoluble monomers such as acrylic esters or water insoluble but acid soluble monomers such as amines (the resultant CP bring distributed into acidic aqueous composition) but generally reverse phase emulsion or suspension polymerisation is utilised when the monomer or monomer blend is soluble in water. The aqueous monomer is emulsified into a suitable non-aqueous liquid, generally in the presence of a water in oil emulsifier, generally in an amount below the critical micell concentration. Emulsifiers, stabilisers, non-aqueous liquids and other reverse phase polymerisation materials and process details are described in, for instance, EP-A-0126528. The CP particles may be dehydrated, for instance by subjecting the dispersion to azeotropic distillation.

The liquid product from the reverse phase polymerisation or emulsion polymerisation is generally used as such, without separation of the polymer particles from it, but if desired dried polymer particles may be separated from the dispersion is known manner. Because these dry particles will be very dusty they should preferably be form d into pellets that will disintergrate upon addition to water.

The polymer-in-oil emulsion that results from reverse phase polymerisation may be added to the composition to be thickened in the presence of oil-in-water emulsifier in conventional manner.

When the polymeric material is cross linked and cationic, and in particular when it is a copolymer of acrylamide with at least 5%, and preferably at least 10%, by weight dialkylamino alkyl acrylate (generally as acid addition or quaternary ammonium salt) the degree of non-linearity is preferably such that the CP has an ionic regain (IR) of at least 15%. IR is calculated as $(x-y/x)$ 100 where x is the ionicity measured after applying standard shear and y is the ionicity of the polymer before applying standard shear.

These values are best determined by forming a 1% composition of the CP in deionised water, allowing this to age for 2 hours and then further diluting it to 0.1% active CP. The ionicity of the CP, y, is measure by Colloid Titration as described by Koch-Light Laboratories Limited in their publication 4/77 KLCD-1. (Alternatively the method described in GB-A-1,579,007 could possible by used to determine y). The ionicity after shear, x, is determined by measuring by the same technique the ionicity of this solution after subjecting it to standard shear.

The shear is best applied to 200 ml of the solution in a substantially cylindrical pot having a diameter of about 8 cm and provided in its base with a rotatable blade about 6cm in diameter, one arm of the blade pointing upwards by about 45 degrees and the other downwards by about 45 degrees. The blade is about 1 mm thick and is rotated at 16,500 rpm in the base of the pot for 10 minutes. These conditions are best provided by the use of a Moulinex homogeniser but other satisfactory conditions can be provided using kitchen blenders such as Kenwood, Hamilton Beach, Iona or Osterizer blenders of a Waring Blender.

In practice the precise conditions of shear are relatively unimportant since, provided the degree of shear is of the same order of magnitude as specified, it will be found that IR is not greatly affected by quite large changes in the amount, for instance the duration of shear, whereas at lower amounts of shear (for instance 1 minute at 16,500 rpm) IR is greatly affected by small changes in shear. Conveniently therefore the value of x is determined at the time when, with a high speed blade, further shear provides little or no further change in ionicity. This generally requires shearing for 10 minutes, but sometimes longer periods, e.g., up to 30 minutes with cooling, may be desired.

The CP's used in the invention preferably have IR above 30%, often in the range 35 to 45%. IR may increase from zero at zero cross linker up to a peak or plateáu at a level around, for instance 10 to 25 ppm, cross linker and preferably IR is at or near this peak or plateáu, generally at as low a level of cross linking as is consistent with the high IR value.

The water dispersible cationic softener used int eh fabric conditioning formulation may be selected from:

(i) dihydrocarbyldialkylammonium salt of the formula:

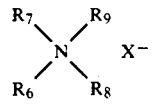

(I)

wherein $R_6$ and $R_7$ are the same or different $C_8$ to $C_{24}$ alkyl or alkenyl groups, which may optionally carry additional functional groups selected from —OH, —O—, —CONH— and —COO— either as substituents or as part of the main alkyl or alkenyl chain, $R_8$ and $R_9$ are the same or different $C_1$–$C_4$ alkyl, hydroxyalkyl or (poly)oxyalkylenegroups, and $X^-$ is an anion selected from a halide, methosulphate and ethosulphate, (ii) an alkylimidazolinium salt of the formula (II):

(ii)

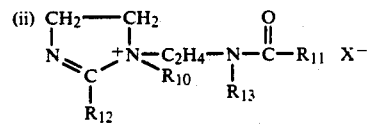

(II)

(iii)

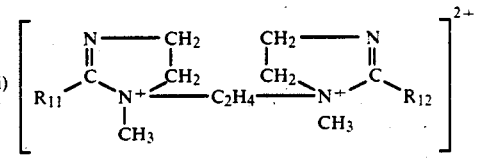

(III)

$2CH_3SO_4^-$ and (iv)

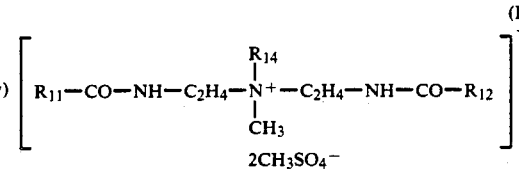

(IV)

where in (ii), (iii) and (iv) above $R_{10}$ is a $C_1$–$C_4$ alkyl or hydroxyalkyl or (poly)oxyalkylene group, $R_{11}$ and $R_{12}$ are the same or different alkyl or alkenyl groups containing from 8 to 24 carbon atoms, $R_{13}$ is hydrogen, a $C_1$–$C_4$ alkyl or a —CO—$R_{11}$ group and $X^-$ is an anion, selected from a halide, methosulphate or ethosulphate, and $R_{14}$=H, alkyl, hydroxyalkyl or (poly)oxyalkylene.

Examples of these cationic softeners of formula (I) above include: dieicosyldimethyl ammonium chloride; didocosyldimethyl ammonium chloride; dioctadecyldimethyl ammonium chloride; dioctadecyldimethyl ammonium methosulphate; ditetradecyldimethyl ammonium chloride and naturally occurring mixtures of above fatty groups, e.g. di(hydrogenated tallow) dimethyl ammonium chloride; di(hydrogenated tallow) dimethyl ammonium methosulphate; ditallow dimethyl ammonium chloride; and dioleyldimethyl ammonium chloride. Di(hydrogenated tallow) dimethyl ammonium chloride or dioctadecyl dimethyl ammonium chloride is preferred.

In the cationic softener represented by formula (I), each of $R_6$ and $R_7$ suitably represents a substituent in which more than 50%, preferably more than 75%, of the groups are $C_{12}$ to $C_{18}$ alkyl or alkenyl groups. More preferably, each of the substituent groups $R_6$ and $R_7$ represent a mixture of alkyl and alkenyl groups, namely from 50–90% $C_{18}$ alkyl or alkenyl groups and from 10 to 50% $C_{16}$ alkyl or alkenyl groups.

Thus, the substituents $R_6$ and $R_7$ are most preferably represented by dioctadecyl groupings, the substituents $R_8$ and $R_9$ are preferably methyl groups, and the anion $X^-$ is preferably a chloride Thus, the preferred softener of formula (I) is di(hydrogenated tallow) dimethyl ammonium chloride or dioctadecyl dimethyl ammonium chloride.

Examples of the imidazolinium salts of formula (II) above include 1-methyl-1-(tallowylamido-) ethyl -2-tallowyl-4,5-dihydroimidazolinium methosulphate and 1-methyl-1-(palmitoylamido)ethyl -2-octadecyl-4,5-dihydro-imidazolinium methosulphate. Other useful imidazolinium materials are 2-heptadecyl-1-methyl-1(2-stearoylamido)-ethyl-imidazolinium methosulphate and 2-lauryl-lhydroxyethyl-1-oleyl-imidazolinium chloride. Such imidazolinium fabric softening components are described more fully in U.S. Pat. No. 4127489 and can be used in the formulations of the present invention.

The water-dispersible cationic softeners referred to herein are commercially available materials under the following trade names or Registered Trade Marks: Dehyquart DAM (ex Henkel et Cie); Arquad 2HT (ex AKZO); Prapagen WK (ex Hoechst); Noramium M2SH (ex CEKA); and the imidazolinium compounds falling within (a) are Rewoquat W7500H, Rewoquat W7500 and Rewoquat W3690 all ex REWO), Casaquat 865 & 888 (ex Thomas Swan) and Blandofen CAZ-75 (ex GAF).

The pH of the formulation is maintained at a value from 2.5–5, preferably from 3.0–4.0 in order to achieve optimum performance.

The CP thickener is suitably used as a 50% w/w dispersion in a mineral oil.

The CP thickener of the present invention is opaque when dispersed in water. Depending upon the concentrations used, if the thickener is used in sufficient quantities, no additional opacifier will be needed. However, at relatively low concentrations of the thickener, a supplementary opacifier may be incorporated.

The formulations of the present invention may contain in addition one of the following as non-ionic softener extenders and/or stability improvers and/or rheology modifiers: such as ethoxylated amide, alcohols, acids and esters with not more than 7EO groups; fatty acid ester or preferably partial ester of mono or polyhydric alcohol or anhydride thereof having from 1–8C atoms; esters of fatty alcohols having from 12–24C atoms and mono or polycarboxylic acids with 1–8C atoms; and R3XR4 where: R3=12–24C R4=1–6C neither interrupted by more than one oxygen link; X=Sulphur, NHCO or CONH.

The aqueous fabric softening formulations can be made by direct addition of the thickener to the aqueous based softener containing the non-ionic and cationic softeners.

It is preferably made by the addition of the cationic and non-ionic softeners in water containing other minor ingredients to an aqueous dispersion of the CP thickener, or, most preferably by dispersing the CP thickener in a molten pre-mix made up of the cationic softener alone or combined with the other coactives and then dispersing the pre-mix into the aqueous seat which may also contain other minor ingredients.

Alternatively, the thickener may be initially diluted gradually to a paste like consistency and then brought to the final concentration.

A feature of this invention is that the cationic softeners in the formulation appear to enhance the thickening ability of the thickeners by an order magnitude when compared with the performance of such thickeners in the absence of cationic components.

The present invention is further illustrated with reference to the following Examples.

EXAMPLES

For the sake of simplicity, the following experiments were carried out with a softening formulation which was an aqueous solution containing a cationic softener to which was added the thickener of the present invention and the improvement in viscosity and opacity monitored.

A reverse phase dispersion was formed by dispersing into a conventional reverse phase non-aqueous liquid containing emulsifying agent and amphipathic stabiliser an aqueous monomer blend consisting of 80% by weight dimethylaminoethyl methacrylate methyl chloride quaternary salt and 20% acrylamide and 15 ppm methylene bis acrylamide. The mixture was degassed and initiated in the conventional manner and polymerisation was allowed to go to completion. The mixture was then subjected to azeotropic distillation to provide a substantially anhydrous dispersion of polymer particles less than 2 micrometers in size dispersed in mineral oil (50% w/w) which was Shell oil 60 Solvent Pale. This CP is designated polymer R below.

The solutions were prepared by initially dispersing the thickener in a cationic softener and then mixing this dispersion with water using a high temperature (65° C.) and vigorous mixing (200–300 rpm) to produce a formulation.

It was found that in the absence of the polymer R thickener, a cationic softener, distearyl dimethyl ammonium chloride (DSDMAC) gave a thin product (viscosity ca. 20 cP at 20 $Sec^{-1}$ at 25° C.) when used in concentrations of 3% w/w and at a pH in the range of 3–3.9. However, in the presence of 0.2% w/w of the 50% w/w dispersion of CP in oil and using only 2.0% w/w of DSDMAC, a good viscous product (viscosity 250–260 cP at 20 $Sec^{-1}$ at 25° C.) was obtained at the same pH range.

The performance of the thickeners of the present invention is shown in the Tables below. In the Tables, the reference to viscosities is based on measurements carried out at 20 $sec^{-1}$ at 25° C. using a Haake viscometer. The shear rates specified correspond to that of liquids when being poured or when running down surfaces.

TABLE 1

Illustrates the thickening power of the polymer R thickener used in the present invention as represented by a plot of aqueous viscosity v that of two of the most effective polymer thickeners conventionally used, i.e. NATROSOL HHBR (Registered Trade Mark) which is a cellulose ether, and a cationic guar gum (Jaguar C-13-S).

TABLE 2

Illustrates (a) the synergistic thickening effect of a cationic softener active (DSDMAC) when combined with the polymer R thickener of the present invention and (b) the near linear relationship between Polymer level and viscosity.

TABLE 3

Illustrates the synergy of the cationic softener (a distearyl imidazolinium methosulphate) with the polymer R thickener of the present invention when compared with the thickener alone. This Table 3 also includes the performance of the guar gum and the cellulose ether for comparison.

A potentially unique combination property is that, unlike soluble thickening polymers, the CP thickeners of the present invention are opaque when dispersed in water. The opacifying power of the CP thickeners of the present invention when compared with a conventional styrene-acrylamide opacifier used in fabric conditioners was found to be indistinguishable at 0.2% over the visible spectrum and, in fact, better than the conventional thickener at ca. 0.1% w/w concentration. For application in fabric conditioners, the CP thickeners of the present invention do not affect rewettability, nor do they build up on cloth in multi-cycle washing. It was found not to interfere with softening.

It has a considerable advantage in thickening fabric conditioners as they do not precipitate cationic actives between pH 3–4.

Where the CP thickeners of the present invention are precipitated, unlike other polymers, they are easily redispersed as they tend not to flocculate the cationic softener.

Physical stability of the CP thickeners of the present invention are easily quantified. At pH values from 3 to 5 the CP thickener is indefinitely stable over all storage regimes e.g. in the DSDMAC and imidazolinium cationic softener dispersions.

Other advantages of the CP thickeners of the present invention are that (a) as a synthetic thickener, the thickening is less likely to be lost as a result of the action of bacterial or enzymic activity, (b) at low levels of use, there is no "stringy" rheology, but at low shear rates e.g at 5 sec and 0.2% w/w concentration (of 50% w/w dispersion in oil) it exhibits a dinamic viscosity of about 28 cP in contrast to conventional NATROSOL HHBR which has a dinamic viscosity of 30cP under the same conditions, and (c) where the viscosity of the finished product is attributable to the thickener alone, the substantially linear relationship between the concentrations used normally in such formulations and the viscosity obtained means that there are no sudden fluctuations of viscosity by marginal variations in dosage of the CP thickener unlike conventional polymers where this relationship can be exponential.

TABLE 1

| | VISCOSITY IN WATER | | |
|---|---|---|---|
| % THICKENER | POLYMER R* | NATROSOL HHBR | JAGUAR C-13-S |
| 0.1 | 56 | 5 | 10 |
| 0.2 | 110 | 10 | 20 |
| 0.3 | 170 | 50 | 60 |
| 0.4 | 230 | 155 | 160 |

ALL VISCOSITIES MEASURED AT 20 SEC-1 AT 25 DEGREES CELSIUS ON HAAKE ROTOVISCOMETER USING M5 MEASURING SYSTEM AND MV1 BOB AND CUP

*Quantities used are based on a 50% w/w dispersion of polymer R in mineral oil.

**distearyl imidazolinium metho sulphate, Regd. Trade Mark, ex REWO.

TABLE 2

| VISCOSITY OF POLYMER R IN DSDMAC | | |
|---|---|---|
| % POLYMER R* | 2% DSDMAC | 3% DSDMAC |
| 0.0 | 20 | 21 |

TABLE 2-continued

| VISCOSITY OF POLYMER R IN DSDMAC | | |
|---|---|---|
| % POLYMER R* | 2% DSDMAC | 3% DSDMAC |
| 0.05 | 65 | 75 |
| 0.1 | 130 | 150 |
| 0.15 | 195 | 225 |
| 0.2 | 260 | 300 |

ALL VISCOSITIES MEASURED AT 20 SEC-1 AT 25 DEGREES CELSIUS ON HAAKE ROTOVISCOMETER USING M5 MEASURING SYSTEM AND MV1 BOB AND CUP

*Quantities used are based on a 50% w/w dispersion of polymer R in mineral oil.

**distearyl imidazolinium metho sulphate. Regd. Trade Mark, ex REWO.

TABLE 3

| | VISCOSITY IN 3% REWOQUAT 7500** | | |
|---|---|---|---|
| % THICKENER | POLYMER R* | NATROSOL HHBR | JAGUAR C-13-S |
| 0.0 | 8 | 8 | 8 |
| 0.05 | 50 | 15 | 20 |
| 0.1 | 100 | 25 | 45 |
| 0.15 | 150 | 50 | 60 |
| 0.2 | 200 | 70 | 90 |

ALL VISCOSITIES MEASURED AT 20 SEC-1 AT 25 DEGREES CELSIUS ON HAAKE ROTOVISCOMETER USING M5 MEASURING SYSTEM AND MV1 BOB AND CUP

*Quantities used are based on a 50% w/w dispersion of polymer R in mineral oil.

**distearyl imidazolinium metho sulphate. Regd. Trade Mark, ex REWO.

We claim:

1. An aqueous based fabric conditioning formulation consisting essentially of effective amounts of a water-dispersible cationic softener and a thickener characterized in that the thickener is a cross-linked cationic polymer that is derivable from a water-soluble cationic acrylic monomer or blend of monomers which is cross-linked by 5 to 45 ppm of across-linking agent comprising polyethylenic functions.

2. A formulation according to claim 1 wherein the cross-linked cationic polymer is derivable from monomers comprising one or more of (a) dialkylaminoalkyl-acrylates or -methacrylates, (b) dialkylaminoalkyl-acrylamides or -methacrylamides, or (c) the quaternary or acid salts of either (a) or (b).

3. A formulation according to claim 1 wherein the cross-linked cationic polymer is derivable from a mixture of cationic monomers and nonionic monomers.

4. A formulation the group consisting of according to claim 3 wherein the nonionic monomer is selected from acrylamide, methacrylamide, N-vinyl pyrrolidone, and lower alkyl water insoluble (meth)acrylic monomers.

5. A formulation according to claim 1 in the cross-linked cationic polymer has a particle size below 10 micrometers.

6. A formulation according to claim 5 wherein the particles are formed by polymerising the acrylic monomer in the presence of a cross-linking agent.

7. A formulation according to claim 1 wherein the cross-linking agent is selected from methylene bis acrylamide, ethylene glycol di-acrylate or -methacrylate, diacrylamide, cyanomethylacrylate, vinyloxyethylacrylate or -methacrylate, formaldehyde, glyoxal and a metal salt.

8. A formulation according to claim 1 wherein the cross-linked cationic polymer is formed from a blend of 0–40% w/w of acrylamide and 100–60% w/w of a quaternary ammonium salt of dialkylaminoethyl methacrylate cross linked with 10 to 40 ppm of a cross linking agent.

9. A formulation according to claim 1 wherein the cross-linked cationic polymer is present in an amount from 0.01–0.5% w/w based on the total aqueous fabric conditioning formulation.

10. A formulation according to claim 1 wherein the cross-linked cationic polymer has a notional molecular weight of 5,000,000 to 30,000,000 and an intrinsic viscosity above 4 dl/g prior to cross-linking.

11. A formulation according to claim 1 rein the cross-linked cationic polymer is cross-linked with at least 5% w/w of dialkylamino alkyl acrylate and has a degree of non-linearity such that the cationic polymer has an ionic regain of at least 15%.

12. A formulation according to claim 1 wherein the formulation contains a water-dispersible cationic softener selected from the group consisting of (i) a dihydrocarbyldialkylammonium salt of the formula:

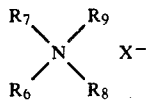

(I)

wherein $R_6$ and $R_7$ are the same or different $C_8$ to $C_{24}$ alkyl or alkenyl groups, which may optionally carry additional functional groups selected from —OH, —0—, —CONH— and —COO— either as substituents or as part of the main alkyl or alkenyl chain, $R_8$ and $R_9$ are the same or different $C_1$–$C_4$ alkyl, hydroxyalkyl or (poly)oxyalkylene groups, and X- is an anion selected from a halide, methosulphate and ethosulphate, (ii) an alkylimidazolinium salt of the formula (11):

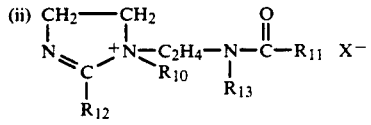

(II)

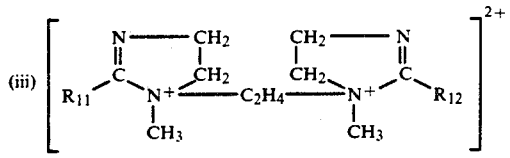

(III)

$2CH_3SO_4^-$ and

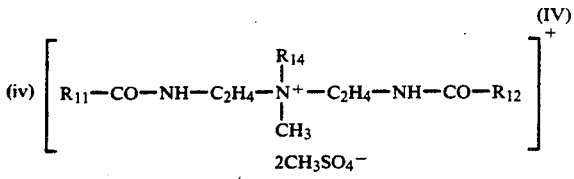

(IV)

where in (ii), (iii) and (iv) above $R_{10}$ is a $C_1$–$C_4$ alkyl or hydroxyalkyl or (poly)oxyalkylene group, $R_{11}$ and $R_{12}$ are the same or different alkyl or alkenyl groups containing from 8 to 24 carbon atoms, $R_{13}$ is hydrogen, a $C_1$–$C_4$ alkyl or a —CO—$R_{11}$ group and $X^-$ is an anion, selected from a halide, methosulphate or ethosulphate, and $R_{14}$=H, alkyl, hydroxyalkyl or (poly)oxyalkylene.

13. A formulation according to claim 1 wherein the pH of the formulation is from 2.5–5.0.

14. A formulation according to claim 1 wherein the cross-linked cationic polymer is used in the formulation as a 50% w/w emulsion in mineral oil.

15. A method of conditioning fabrics which comprises contacting a fabric with an aqueous composition comprises a water-soluble cationic softener and a thickener which is a cross-linked cationic polymer that is derivable from a water soluble cationic acrylic monomer or blend of monomers which is cross-linked by 5 to 45 ppm of a cross-linking agent comprising polyethylenic functions.

16. A method according to claim 15, wherein the cross-linked cationic polymer is derivable from monomers comprising one or more of (a) dialkylaminoalkyl-acrylates or -methacrylates, (b) dialkylaminoalkyl-acrylamides or -methacrylamides, or (c) the quaternary or acid salts of either (a) or (b).

17. A method according to claim 15, wherein the cross-linked cationic polymer is derivable from a mixture of cationic monomers and nonionic monomers.

18. A method according to claim 15, wherein the nonionic monomer is selected from the group consisting of acrylamide, methacrylamide, N-vinyl pyrrolidone, and lower alkyl water insoluble (meth)acrylic monomers.

19. A method according to claim 15, wherein the cross-linked cationic polymer has a particle size below 10 micrometers.

20. A method according to claim 19, wherein the particles are formed by polymerising the acrylic monomer in the presence of a cross-linking agent.

21. A method according to claim 15, wherein the cross-linking agent is selected from the group consisting of methylene bis acrylamide, ethylene glycol di-acrylate or -methacrylate, diacrylamide, cyanomethylacrylate, vinyloxyethyl-acrylate or -methacrylate, formaldehyde, glyoxal and a metal salt.

22. A method according to claim 15, wherein the cross-linked cationic polymer is formed from a blend of 0–40% w/w of acrylamide and 100–60% w/w of a quaternary ammonium salt of dialkylaminoethyl methacrylate cross-linked with 10 to 40 ppm of a cross-linking agent.

23. A method according to claim 15, wherein the cross-linked cationic polymer is present in an amount from 0.01–0.5% w/w based on the total aqueous fabric conditioning composition.

24. A method according to claim 15, wherein the cross-linked cationic polymer is present in an amount form 0.01–0.5% w/w 5,000,000 to 30,000,000 and an intrinsic viscosity above 4 dl/g prior to cross-linking.

25. A method according to claim 15, wherein the cross-linked cationic polymer is cross-linked with at least 5% w/w of dialkylamino alkyl acrylate and has a degree of non-linearity such that the cationic polymer has an ionic regain of at least 15%.

26. A method according to claim 15, wherein the composition contains a water-dispersible cationic softener selected from the group consisting of (i) a dihydrocarbyldialkylammonium salt of the formula:

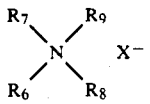

(I)

wherein $R_6$ and $R_7$ are the same or different $C_8$ to $C_{24}$ alkyl or alkenyl groups, which may optionally carry additional functional groups selected from the group consisting of —OH, —O—, —CONH— and —COO— either as substituents or as part of the main alkyl or alkenyl chain, $R_8$ and $R_9$ are the same or different $C_1$-$C_4$ alkyl, hydroxyalkyl or (poly)oxyalkylene groups, and $X^-$ is an anion selected from a halide, methosulphate and ethosulphate,

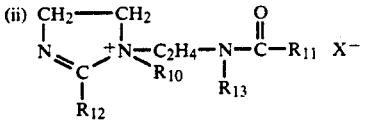

(II)

-continued

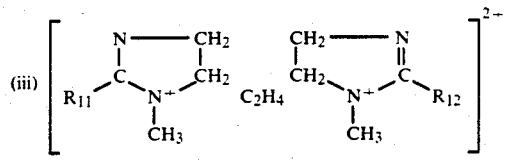

(III)

$2CH_3SO_4^-$ and

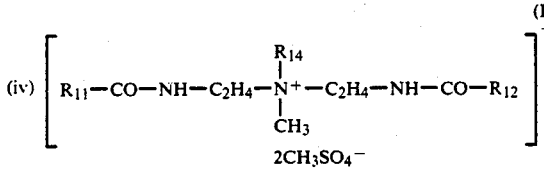

(IV)

where in (ii), (iii) and (iv) above $R_{10}$ is a $C_1$-$C_4$ akyl or hydroxyalkyl or (poly)oxyalkylene group, $R_{11}$ and $R_{12}$ are the same or different alkyl or alkenyl groups containing from 8 to 24 carbon atoms, $R_{13}$ is hydrogen, a $C_1$-$C_4$ alkyl or a —CO—$R_{11}$ group and $X^-$ si an anion, selected from a halide, methosulphate or ethosulphate, and $R_{14}$=H, alkyl, hydroxyalkyl or (poly)oxyalkylene.

27. A method according to claim 15, wherein the ph of the composition is from 2.5–5.0.

28. A method according to claim 15, wherein the cross-linked cationic polymer is used in the composition as a 50% w/w emulsion in mineral oil.

* * * * *

UNITED STATES PATENT AND TRADEMARK OFFICE

CERTIFICATE OF CORRECTION

PATENT NO. : 5,114,600

DATED : May 19, 1992

INVENTOR(S) : IAN S. BIGGIN et al

It is certified that error appears in the above-identified patent and that said Letters Patent is hereby corrected as shown below:

Col. 2, l. 11-12, correct the spelling of "in the"

Col. 2, l. 15, correct the spelling of "in the"

Col. 2, l. 38, correct the spelling of "in the"

Col. 3, l. 24, before "specification" change "the" to --that--

Col. 4, l. 42, correct the designation "IV"

Col. 4, l. 43, correct the spelling of "be"

Col. 4, l. 50, correct the spelling of "being"

Col. 5, l. 1, correct the spelling of "formed"

Col. 5, l. 65, correct the spelling of "in the"

Col. 10, l. 46, delete the words "the group consisting of"

Col. 10, l. 50, change "in" to --wherein--

Col. 11, l. 9, change "hein" to --wherein--

Col. 11, l. 34, , after "formula" change "11)" to --(II)--

Col. 12, l. 55 and 56, after "polymer" insert --has a notional molecular weight-- and delete "is present in an amount form 0.01-0.5% w/w"

Claim 26, col. 14, l. 21, correct the spelling of the word "alkyl"

Claim 26, col. 14, l. 26, correct the spelling of the word "is" before "an anion"

UNITED STATES PATENT AND TRADEMARK OFFICE

CERTIFICATE OF CORRECTION

PATENT NO. : 5,114,600

DATED : May 19, 1992

INVENTOR(S) : IAN S. BIGGIN et al

It is certified that error appears in the above-indentified patent and that said Letters Patent is hereby corrected as shown below:

Col. 10, l. 47, after "selected from", insert --the group consisting of--

Signed and Sealed this

Twenty-third Day of November, 1993

Bruce Lehman

*Attest:*

BRUCE LEHMAN

*Attesting Officer*

*Commissioner of Patents and Trademarks*